United States Patent [19]

Jorgensen

[11] Patent Number: 4,878,811

[45] Date of Patent: Nov. 7, 1989

[54] AXIAL COMPRESSOR BLADE ASSEMBLY

[75] Inventor: Stephen W. Jorgensen, West Palm Beach, Fla.

[73] Assignee: United Technologies Corporation, Hartford, Conn.

[21] Appl. No.: 270,994

[22] Filed: Nov. 14, 1988

[51] Int. Cl.[4] ..... F01D 5/22

[52] U.S. Cl. ..... 416/215; 416/190; 416/193 A

[58] Field of Search ..... 416/215–218, 416/193 A, 190, 191

[56] References Cited

U.S. PATENT DOCUMENTS

| | | | |
|---|---|---|---|
| 787,907 | 4/1905 | Farwell | 416/215 X |
| 2,148,653 | 2/1939 | Semar . | |
| 2,391,623 | 12/1945 | Heppner | 416/191 |
| 2,805,838 | 9/1957 | Pickup | 416/216 X |
| 2,955,799 | 10/1960 | Oickle | 416/190 X |
| 3,014,695 | 12/1961 | Rankin et al. | 416/193 A X |
| 3,810,711 | 5/1974 | Emmerson et al. | 416/97 |
| 3,923,420 | 12/1975 | Chifos | 416/190 |
| 4,165,949 | 8/1979 | Riollet | 415/77 |
| 4,280,795 | 7/1981 | Trousdell | 416/218 |
| 4,465,432 | 8/1984 | Mandet et al. | 416/215 |
| 4,688,992 | 8/1987 | Kirkpatrick et al. | 416/215 |
| 4,767,273 | 8/1988 | Partington | 416/191 |

FOREIGN PATENT DOCUMENTS

| | | | |
|---|---|---|---|
| 564048 | 9/1958 | Canada | 416/215 |
| 436567 | 11/1926 | Fed. Rep. of Germany | 416/215 |
| 1085643 | 7/1960 | Fed. Rep. of Germany | 416/215 |
| 985327 | 12/1982 | U.S.S.R. | 416/191 |
| 137379 | 5/1923 | United Kingdom | 416/215 |
| 2156908 | 10/1985 | United Kingdom | 416/215 |

*Primary Examiner*—Everette A. Powell, Jr.
*Attorney, Agent, or Firm*—Edward L. Kochey, Jr.

[57] ABSTRACT

Blade platforms (26) for compressor blades with airfoils (22) in high solidity relationship have edges of a major portion (44) a minor portion (46), and a canted intermediate portion (48). Minimum clearance (54) exists between the major portions (44) whereby twisting during stackup or operation is avoided. A circumferential seal (60, 64) is located under the platform coincident with major portion (44).

7 Claims, 3 Drawing Sheets

AXIAL COMPRESSOR BLADE ASSEMBLY

The Government has rights in this invention pursuant to a contract awarded by the Department of the Air Force.

DESCRIPTION

1. Technical Field

The invention relates to axial compressors and in particular to blade assemblies therefore.

2. Background

In many cases compressor blades of a multi-stage axial compressor are secured to the rotor disks with fir tree blade roots. The roots slide into axially extending dovetail slots. This construction is feasible when there is convenient axis to the slot area for machining.

Lighter rotors may be built using drum type construction. This, however, interferes with access to the slot area. Therefore, an alternate construction uses a circumferential slot in the rotor disk to hold the blade roots. The blades are each passed into the slot through a entry slot and slide around the circumference until a full array of blades is installed.

With rectangular blade platforms such construction may be satisfactorily effected. However, on occasions the compressor design dictates high solidity requirement of the compressor blades. This means that when looking in the axial direction the blades overlap. Accordingly, the blades do not fit on a rectangular platform and a skewed platform must be used such as illustrated by platform A supporting blades B in FIG. 1.

During assembly of the blades the platforms may twist as shown in FIG. 2. When this happens the circumferential dimension L reduces to L′ resulting in looseness of the platforms. Accordingly, this results in indeterminate spacing of the blades, sometimes to such an extent that an extra blade may even be installed. Also, during operation the blades are subject to such twisting or looseness.

One attempt to cure this problem is shown in FIG. 3 where rails C engage rim D. These rails must be tight with very little clearance to resist the twist and also to seal against recirculating air leakage between the blade platform and the rim. On the other hand, they must have ample clearance to permit them to slide around the circumference for assembly. Such design is expensive to manufacture to the tight required tolerances.

SUMMARY OF THE INVENTION

In a bladed drum type axial compressor assembly a plurality of disks each have a rim with a circumferential blade root retention slot. A plurality of blades are installed in each slot with each blade having an airfoil, a blade platform, and a root. The roots are retained within the slots with the airfoils in high solidity relationship with each other. Each blade platform has two circumferentially oriented ends with a first major axial edge portion at the first end which is substantially perpendicular to the end. The second, minor axial edge portion is at the second end and substantially perpendicular to that end. A canted intermediate edge portion joins the first and second axial portions. The plurality of blades are assembled with a minimum clearance between the major axial portions as compared to the other portions.

With the minimum clearance being at the major axial portions, the platforms operate as do rectangular portions to resist twisting during stackup at assembly. The greater clearances at the other portions establish the major portion as the determinant surface without requiring high tolerance manufacturing of the platform edges. The major portion also operates to resist twisting during operation. With the edges of the blade platform being substantially perpendicular to the ends there is no acute angle point of the blade platform which would be subject to deleterious vibration.

DESCRIPTION OF THE PREFERRED EMBODIMENT

Figure 5:
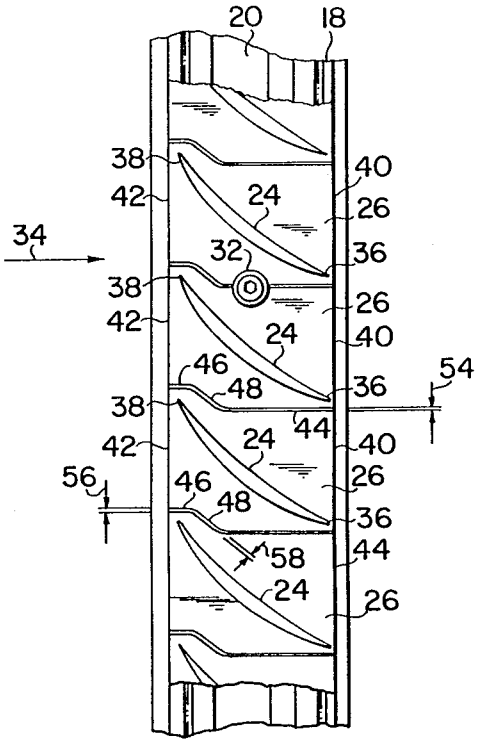
FIG. 5 is a plan view of the airfoil and platform as installed in the disk.
Figure 3:
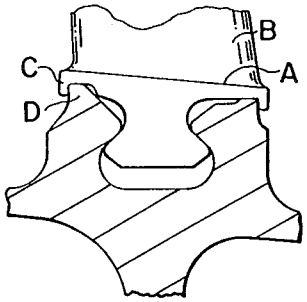
FIG. 3 PRIOR ART
FIG. 3 shows the prior art blades with a guide rail.
Figure 1:
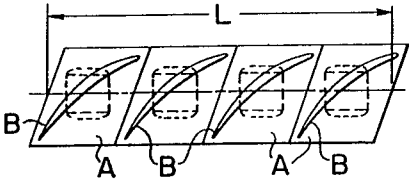
FIG. 1 PRIOR ART
FIG. 1 shows the prior art skewed blade platforms.
Figure 2:
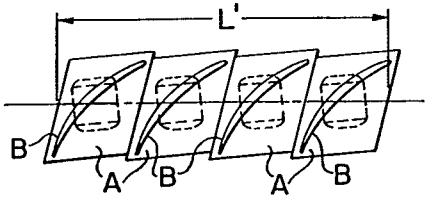
FIG. 2 PRIOR ART
FIG. 2 shows the prior art blade platforms as they twist.
Figure 6:
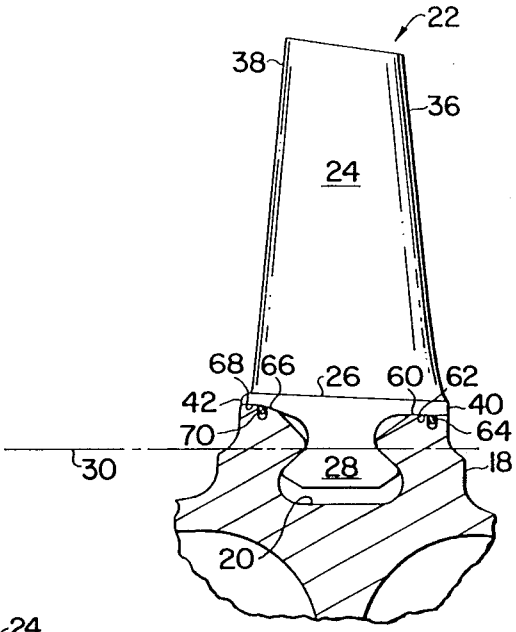
FIG. 6 is a side elevation of an installed blade.
Figure 7:
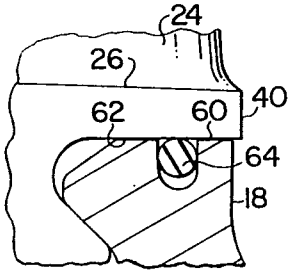
FIG. 7 is a detail of the under platform seal.
Figure 4:
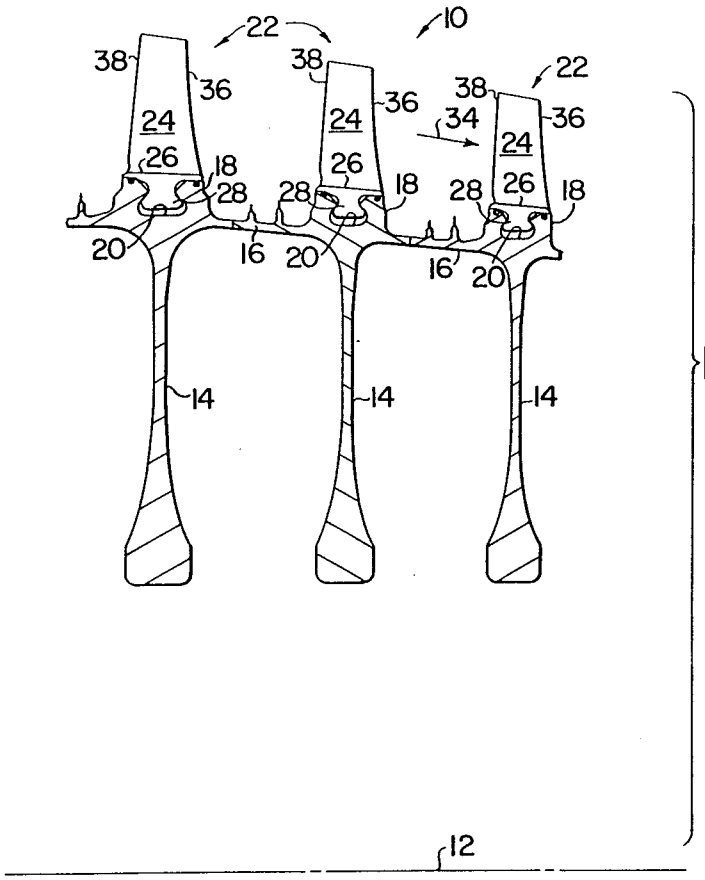
FIG. 4 shows a compressor rotor of drum type construction.
Figure 8:
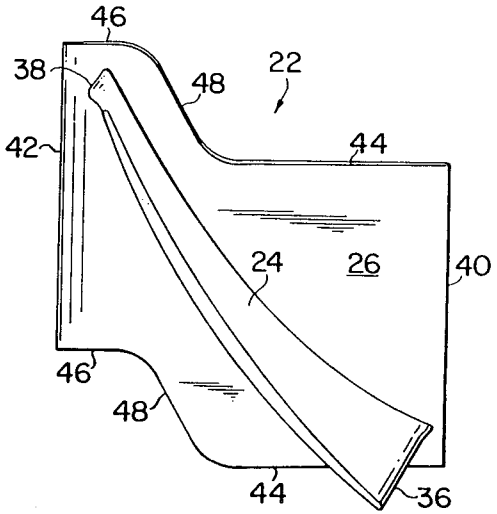
FIG. 8 is a plan view of a blade.

Referring to FIG. 4, a drum type compressor rotor 10 rotating around center line 12 is formed of a plurality of disks 14. These disks are joined by extensions 16 forming the drum type rotor.

Each disk has a rim 18 including a circumferential slot 20. A plurality of blades 22 are installed in each slot.

Each blade 22 includes an airfoil 24, a blade platform 26 and a root 28. The root 28 in conjunction with slot 20 is designed so that the root and the rim are at a set radial location by intersecting that Z plane 30.

The circumferentially extending slot 20 has at one location in its circumference radially oriented loading slots which permits the blade to be installed in the radial direction whereupon it is then slide around the circumference inside slot 20. Once all the blades are installed, one or more locks 32 are secured to prevent further movement of the series of blades. When the last blade is installed, it along with the already installed blades is moved over one-half a blade spacing whereby all blades are away from the loading slot.

Airflow is in the direction shown by arrow 34 with leading edge 38 overlapping trailing edge 36 as viewed in the axial direction, thereby forming the high solidity relationship discussed above. Each blade platform 26 has a circumferentially extending first end 42 at the leading edge of the platform and a circumferentially extending second end 40 at the trailing side of the platform. A first major axial edge portion 44 extends from end 40 substantially perpendicular to end 40 and preferably greater than half the axial extent of the platform. If this edge should deviate from perpendicular by a significant amount, one of the two angles of the blade platform would form an acute angle which is then subject to vibration. Accordingly, it is preferable to maintain this edge in the near perpendicular position. A second minor axial portion edge 46 is located at the leading edge of the platform and substantially perpendicular to end 42. An intermediate canted portion 48 joins the two axially extending portions.

Each platform is fabricated such that clearance 54 between edges 44 is always less than clearance 56 between edges 46 and clearance 58 between edges 48. This insures that on stacking contact will be formed by close clearance 54 with some opening remaining at the other portions. Accordingly, these other portions will not interfere with accurate precise stackup of the blade assemblies.

Air pressure is increased in passing through the compressor blades 22. Accordingly, it is possible for leakage to occur beneath the blade platforms resulting in recirculation of the air being compressed and accordingly a reduction in efficiency. It is desirable to avoid or minimize such recirculation. The rim 18 has a first circumferential seal surface 60 adjacent to slot 20 on a trailing edge side of the slot. Each blade platform has a first circumferentially extending seal surface 62 on the underside of platform 26 and coincident with the first major axial edge portion 44. A circumferential seal in the form of seal ring 64 is located to sealingly abut the seal surfaces on both the rim and the blade platforms.

It is on this trailing edge side of the platforms that there is minimal clearance between the platforms. The seal and seal ring located at this position accomplishes the maximum sealing because of the minimum clearance between platform edges and accordingly minimum leakage between the platforms.

Rim 18 also has a second circumferential seal surface 66 adjacent to slot 20 on the leading edge side. Each blade platform also has a second circumferentially extending seal surface 68 on the underside of each platform and circumferential seal ring 70 is located between the two seal surfaces. This seal arrangement is located coincident with the second minor axial edge portion.

Figure 10:
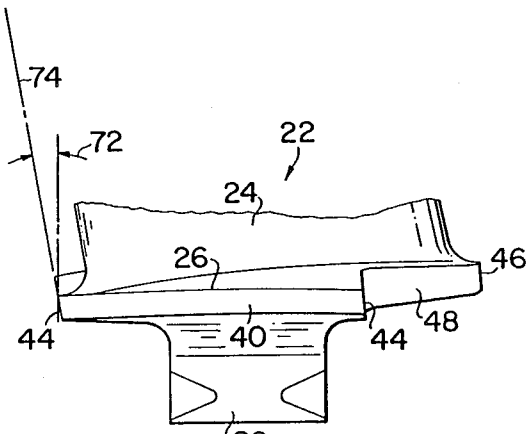
FIG. 10 is a front elevation of FIG. 8.
Figure 9:
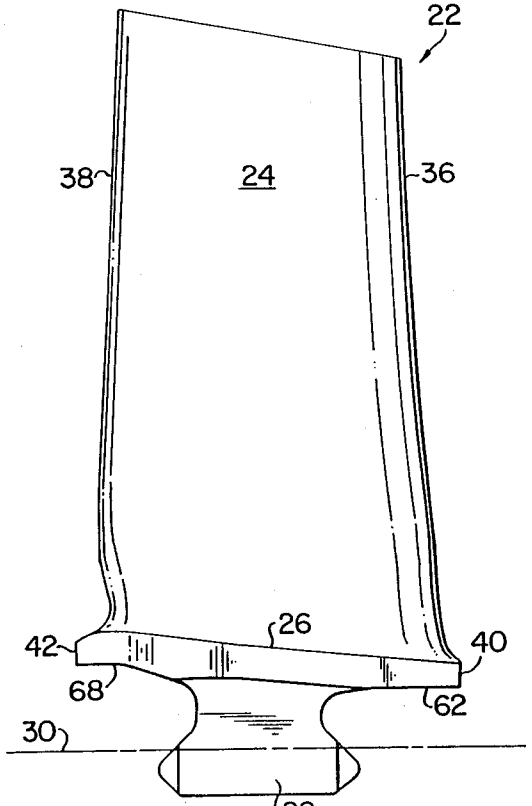
FIG. 9 is a side elevation of FIG. 8.

It can be seen in FIG. 10 that edge surfaces 44 while substantially extending in a radial direction are located with an angle 72 away from the precise radial direction. Edge surface 44 along with edge surfaces 46 and 48 are preferably formed by grinding in a single pass. Because of the potential extension of airfoil 24 beyond the edge of the platform, use of a precisely perpendicular edge would create interference between the grinding wheel and the blade. Accordingly, the edge portion 44 is formed off of the precise radial direction in an amount such that extension 74 of this surface clears all portions of airfoil 24.

In assembling the bladed rotor disk the root of each blade is passed through a radial entry slot and passed circumferentially around the disk with the root engaging the circumferential slot at the Z plane. This is continued until all but the final blade is installed. At this point the remaining gap is measured and compared with the width of the remaining blade. An appropriate final blade is selected with the blade platform producing a final gap between 0 and 0.02 inches. All blades are then slid around an additional half spacing and locked in place.

Since the blade platforms interact at the major axial edge portion, they do not twist during stackup and accordingly precise tolerances can be maintained. The same substantially axial edge portion interacts with the adjacent edge portions during operation to minimize twisting at that time. The use of the perpendicular intersection at the ends of the platform avoid acute angles producing fingers subject to vibration.

I claim:

1. A bladed drum type compressor assembly comprising:

a plurality of disks each having a rim with a circumferential blade root retention slot therein;

a plurality of blades installed in each slot, each blade having an airfoil, a blade platform supporting said airfoil, and a root supporting said blade platform;

said blade roots retained within said slots with said airfoils in high solidity relationship with each other;

each blade platform having two circumferentially oriented ends, a first major axial edge portion adjacent a first end and substantially perpendicular to said first end, a second minor axial edge portion adjacent to the second end and substantially perpendicular to said second end, a canted intermediate edge portion intermediate said first and second axial edge portions; and said plurality of blades assembled with the minimum clearance between adjacent platforms occurring between said first major portions as compared to said second minor portions and said canted intermediate portions.

2. An apparatus as in claim 1:

said major axial portions being greater than one-half he axial extent of said platforms.

3. An apparatus as in claim 1:

said first major axial portions being located at the trailing edge of said blade platform.

4. An apparatus as in claim 3:

said rim having a first circumferential seal surface adjacent said slot on the trailing edge side of said slot;

said blade platforms each having a first circumferentially extending seal surface on the underside of said platforms at an axial position coincident with said first major axial portion; and a circumferential seal between said first circumferential seal surface of said rim and said first circumferentially extending surface of each blade platform.

5. An apparatus as in claim 4:

said rim also having a second circumferential seal surface adjacent said slot on the leading edge side thereof;

said blade platforms each also having a second circumferentially extending seal surface on the underside of said platforms at an axial position coincident with said second minor axial portion; and a circumferential seal between said second circumferential seal surface of said rim and said second circumferentially extending surface of each blade platform.

6. An apparatus as in claim 1:

said axial edge portions and said intermediate edge portion of each platform having the edge surface thereof extending in a substantially radial direction at an angle away from the precise radial direction in an amount such that an extension of said edge surfaces clears said airfoil.

7. An apparatus as in claim 4:

said axial edge portions and said intermediate edge portion of each platform having the edge surface thereof extending in a substantially radial direction at an angle away from the precise radial direction in an amount such that an extension of said edge surfaces clears said airfoil.

* * * * *